US005576821A

United States Patent [19]

Rasch et al.

[11] Patent Number: 5,576,821

[45] Date of Patent: Nov. 19, 1996

[54] FUSER RELEASE AGENT MANAGEMENT (RAM) SYSTEM HAVING A NON-CONTINUOUS PATTERN AGENT ROLL

[75] Inventors: Kenneth R. Rasch, Fairport; Russell A. Parisi, Williamson; Barry J. Gheer; Bruce A. LaPlant, both of Webster; Tab A. Tress, Henrietta, all of N.Y.

[73] Assignee: Xerox Corporation, Stamford, Conn.

[21] Appl. No.: 573,984

[22] Filed: Dec. 18, 1995

[51] Int. Cl.[6] ..... G03G 15/20

[52] U.S. Cl. ..... 355/284; 355/285

[58] Field of Search ..... 355/284, 282, 355/285, 300; 118/DIG. 1

[56] References Cited

U.S. PATENT DOCUMENTS

| | | | |
|---|---|---|---|
| 3,941,558 | 3/1976 | Takiguchi | 432/60 |
| 4,393,804 | 7/1983 | Nygard et al. | 118/60 |
| 5,045,890 | 9/1991 | DeBolt et al. | 355/284 |
| 5,049,944 | 9/1991 | DeBolt et al. | 355/284 |
| 5,420,678 | 5/1995 | Rasch et al. | 355/284 |
| 5,452,065 | 9/1995 | Bell | 355/283 |
| 5,493,375 | 2/1996 | Moser | 355/284 X |
| 5,500,722 | 3/1996 | Jacobs | 355/284 |

*Primary Examiner*—R. L. Moses
*Attorney, Agent, or Firm*—Tallam I. Nguti

[57] ABSTRACT

In a reproduction machine having a fuser roller for fusing toner images on an image bearing sheet, a release agent management (RAM) system for applying an image offset prevent release agent to the fuser roller. The RAM system includes a rotatable supply core located to a first side of the fuser roller, a rotatable take up core located to a second side of the fuser roller, a release agent impregnated web member having a portion threaded between the supply core and the take-up core for contacting, and applying release agent to, the fuser roller, and a release agent supplying roll positioned for contacting and supplying release agent to the threaded portion of the web member. The release agent supplying roll has a non-continuous surface pattern that includes release agent supplying surface areas for contacting the threaded portion of the web member, and release agent non-supplying surface areas out of contact with the threaded portion of the web member.

11 Claims, 4 Drawing Sheets

FUSER RELEASE AGENT MANAGEMENT (RAM) SYSTEM HAVING A NON-CONTINUOUS PATTERN AGENT ROLL

BACKGROUND OF THE INVENTION

This invention relates to fuser apparatus for electrostatographic reproduction machines and in particular to a fusing oil supply roll assembly in a roll type fuser release agent management (RAM) system.

In the process of xerography, a light image of an original to be reproduced is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto in one of various ways, for example, as by heat and pressure.

In order to affix or fuse electroscopic toner material onto a support member by heat and pressure, it is necessary to elevate the temperature of the toner material to a point at which the constituents of the toner material coalesce and become tacky while simultaneously applying pressure. This action causes the toner to flow to some extent into the fibers or pores of support members or otherwise upon the surfaces thereof. Thereafter, as the toner material cools, solidification of the toner material occurs causing the toner material to be bonded firmly to the support member. In both the xerographic as well as the electrographic recording arts, the use of thermal energy and pressure for fixing toner images onto a support member is old and well known.

One approach to heat and pressure fusing of electroscopic toner images onto a support has been to pass the support with the toner images thereon between a pair of opposed fusing rolls or roller members, at least one of which is internally heated. The opposed fusing rollers each have a length sufficient to handle different cross-track dimensions of image support members or copy sheets. During operation of a fusing system of this type, the support member or copy sheet to which the toner images are electrostatically adhered is moved through the nip formed between the fusing rolls with the toner image contacting the heated or fuser roll of the pair, thereby to effect heating of the toner images within the nip. By controlling the heat transferred to the toner, virtually no offset of the toner particles from the copy sheet to the fuser roll is experienced under normal conditions. This is because the heat applied to the surface of the roller is insufficient to raise the temperature of the surface of the roller above a "hot offset" temperature of the toner. Ordinarily, at such a hot offset temperature, the toner particles in the image areas of the toner liquefy and cause a splitting action in the molten toner resulting in "hot offset." Splitting occurs when the cohesive forces holding the viscous toner mass together is less than the adhesive forces tending to offset it to a contacting surface such as that of the hot fuser roll.

Occasionally, however, toner particles will offset to the fuser roll due to an insufficient application of heat to the surface of the fuser roll (referred to as, "cold" offsetting). It may also offset due to imperfections in the properties of the surface of the roll; or due to the toner particles insufficiently adhering electrostatically to the copy sheet. In any such case, toner particles transferred to the surface of the hot fuser roll are undesirable, and likely to be transferred subsequently to the backup roll during periods of time when no copy paper is in the nip.

In addition, toner particles can be undesirably picked up by the fuser and/or backup rolls during fusing of duplex copies or simply from the surroundings of the reproducing apparatus.

One arrangement for minimizing the foregoing problems, particularly that which is commonly referred to as "offsetting," has been to provide a fuser roll with an outer surface or covering of polytetrafluoroethylene, known by the tradename Teflon to which a release agent such as silicone oil is applied, the thickness of the Teflon being on the order of several mils and the thickness of the oil being less than 1 micron. Silicone based (polydimethylsiloxane) oils which possesses a relatively low surface energy, have been found to be materials that are suitable for use in the heated fuser roll environment where Teflon constitutes the outer surface of the fuser roll. In practice, a thin layer of silicone oil is applied to the surface of the heated roll to form an interface between the roll surface and the toner images carried on the support material. Thus, a low surface energy layer is presented to the toner as it passes through the fuser nip and thereby prevents toner from offsetting to the fuser roll surface.

In another arrangement, both the heated or fuser roll and the pressure roll can each be coated with a silicone rubber outer layerin order to enhance copy quality. In such an arrangement however, the fuser roll is more likely to fail prematurely from swelling than a roll coated with Teflon.

A fuser roll construction of the type described above is fabricated by applying in any suitable manner a solid layer of abhesive material to a rigid core or substrate such as the solid Teflon outer surface or covering of the aforementioned arrangement.

Various systems have been used to deliver release agent fluid to the fuser roll including ones that use oil soaked rolls and wicks with and without supply sumps as well as oil impregnated webs. The oil soaked rolls and wicks generally suffer from the difficulty in that they require a sump of oil to replenish the roll and the wick as its supply of release agent is depleted by transfer to the fuser roll. Furthermore, a wick suffers from the difficulty of a relatively short life, around 10,000 prints. Furthermore, these systems suffer from the further difficulty, in that, their surfaces in contact with the fuser roll are constant whereby contamination particularly by toner and paper can readily occur further reducing valuable life. The web systems, on the other hand are limited in the quantity of oil they can deliver.

U.S. Pat. No. 3,941,558 to Takiguchi discloses a rolled web impregnated with silicone oil for preventing offset. The web has a thickness of 2 mm, a total length of 50 cm, and travels one cm per thousand copies between the supply and take-up rollers. This system transfers about 0.003 cc of oil to the fuser per copy.

U.S. Pat. No. 4,393,804 to Nygard et al. discloses a rolled web system that moves between a supply core and take-up roller. A felt applicator supplies oil from a supply reservoir to the web. The take-up core is driven by a slip clutch at a speed greater than the speed of the pressure roller, thus exerting tension on the web. The web is between one and two mm in thickness and moves at a constant speed of five cm per 200 to 1,000 copies.

U.S. Pat. No. 5,049,944 granted to DeBolt et al on Sep. 17, 1991, relates to apparatus for applying offset preventing liquid to a fuser roll including: a supply core; a rotatable take up core; an oil impregnated web member adapted to be moved from the supply core to the take up core; a motor mechanically coupled to the take up roll for driving the web member from the the supply core to the take up core; a pressure roll in engagement with the web member and positioned to provide a contact nip for the web member with the fuser roll opposite the pressure roll wherein the contact of the web member with the fuser roll transfers oil from the web member to the fuser roll and control means to vary the duty cycle operation of the motor to drive the web member at a relatively constant linear speed at the contact nip. In addition to the oil impregnated web, a foam pinch roll is also impregnated with release agent material to insure that any sections of the web that may have been loaded with an inadequate quantity of silicone oil are supplied with additional release agent material.

In addition, there are several automatic Reproduction machines commercially available. For example, the Canon 3225, 3725, 3000 series, 4000 series and 5000 series products all have liquid release agent impregnated webs supported between a supply roll and a take-up roll and urged into contact with the fuser roll by an open celled foam pinch roll. Additionally, the Xerox™ 5028™ machine utilizes an oil impregnated web for application of between 0.1 to 0.5 micro liters per copy of release agent material to a heated fuser roll.

RAM systems such as the examples disclosed above, ordinarily provide an adequate quantity of release agent material for reproduction machines that regularly use a mix of copy sheets some of which have cross-track dimensions at the fuser roll that are equal to the maximum length of the release agent covered surface area of the fuser roll. Unfortunately, however, there are some reproduction machine applications that do not have a need for, and do not use such a mix of copy sheets. In particular, there are such reproduction machine applications in which the sheets used are, for example, mainly legal size sheets fed short edge first, and thus having a cross-track dimension that is less than the length of the release agent covered surface area. As a result, that length portion of the fuser roll receiving release agent applications continually from the RAM system but not making any agent-losing contact with copy sheets, tends to undesirably swell, causing premature failure of the fuser roll.

SUMMARY OF THE INVENTION

In accordance with one aspect of the present invention, there is provided in a reproduction machine having a fuser roller for fusing toner images on an image bearing sheet, a release agent management (RAM) system for applying an image offset prevent release agent to the fuser roller. The RAM system includes a rotatable supply core located to a first side of the fuser roller, a rotatable take up core located to a second side of the fuser roller, a release agent impregnated web member for contacting, and applying release agent to, the fuser roller, and a release agent supplying roll positioned for contacting and supplying release agent to a threaded portion of the web member. The release agent supplying roll has a non-continuous surface pattern that includes release agent supplying surface areas and release agent non-supplying surface areas.

Other features of the present invention will become apparent from the following drawings and description.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 5:
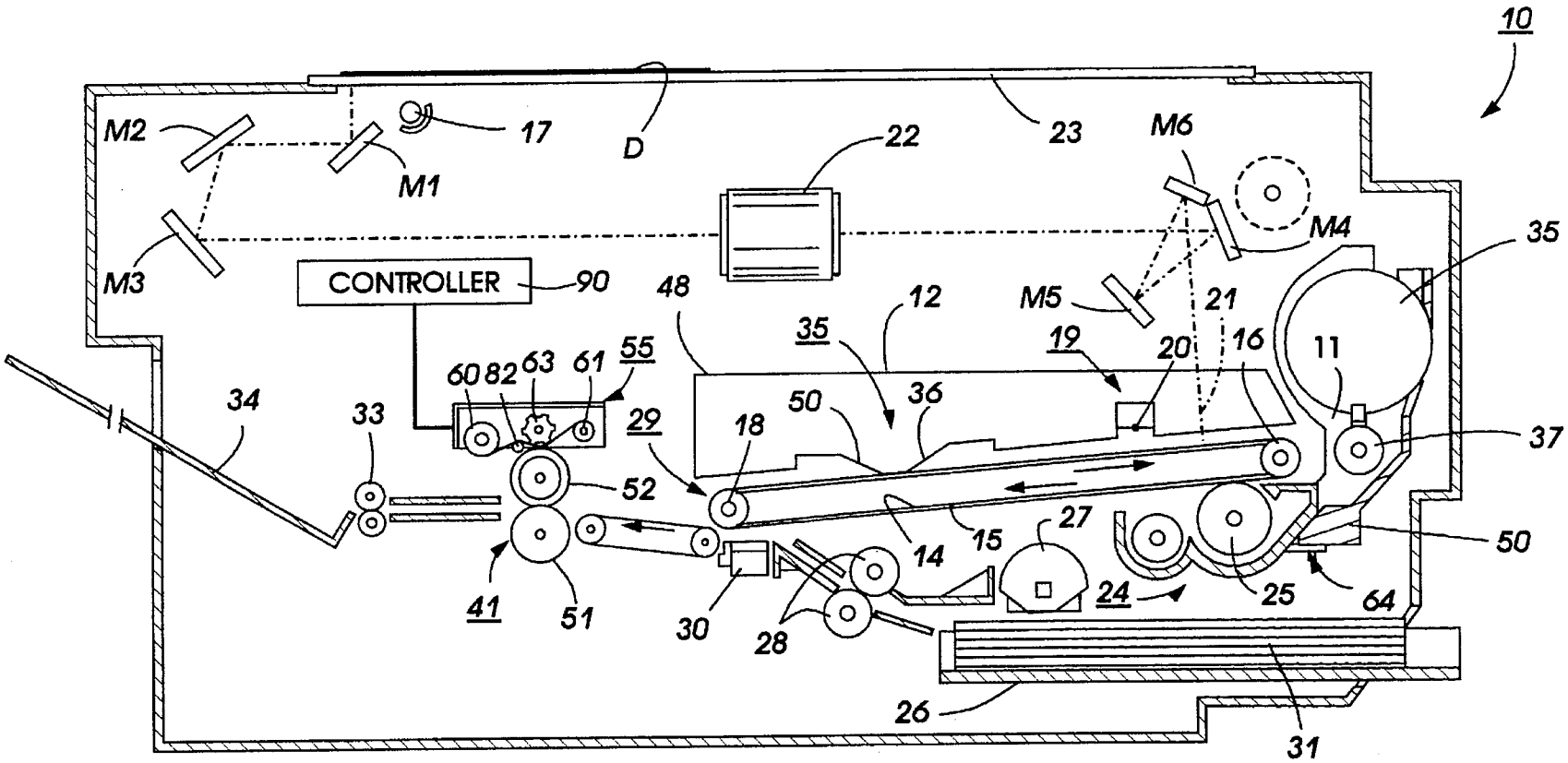
FIG. 5 is a schematic representation in cross-section of an automatic electrostatographic reproduction machine incorporating the fuser apparatus of FIG. 1.

Referring first to FIG. 5, there is shown by way of example, an automatic electrostatographic reproducing machine 10 which includes a RAM system and a patterned RAM roll according to the present invention. The reproducing machine depicted in FIG. 5 illustrates the various components utilized therein for producing copies from an original document. Although the apparatus of the present invention is particularly well adapted for use in automatic electrostatographic reproducing machines, it should become evident from the following description that it is equally well suited for use in a wide variety of processing systems including electrostatographic reproduction systems and is not necessarily limited in application to the particular embodiment or embodiment shown herein.

The reproducing machine 10 illustrated in FIG. 5 employs a removable processing cartridge 12 which may be inserted and withdrawn from the main machine frame. Cartridge 12 includes an image recording belt like member 14 the outer periphery of which is coated with a suitable photoconductive material forming an image bearing surface 15. The belt is suitably mounted for movement within the cartridge about driven transport roll 16, around idler roll 18 and travels in the direction indicated by the arrows on the inner run of the belt to bring the image bearing surface 15 past a plurality of xerographic processing stations. Suitable drive means such as a motor, not shown, are provided to power and coordinate the motion of the various cooperating machine components whereby a faithful reproduction of an original input image is recorded on the surface 15 and then transferred to a sheet of final support material 31, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafter, the belt 14 is driven to exposure station 21 wherein the charged photoconductive surface 15 is exposed to the light image of the original document, whereby the charge is selectively dissipated in the light exposed regions to record the original input image in the form of an electrostatic latent image on the surface 15.

The optical arrangement creating the latent image comprises a scanning optical system with lamp 17 and mirrors $M_1$, $M_2$, $M_3$ mounted to a a scanning carriage (not shown) to scan an original document D on the imaging platen 23, lens 22 and mirrors $M_4$, $M_5$, $M_6$ to transmit the image to the photoconductive belt 14 in a well known manner. The speed of the scanning carriage and the speed of the photoconductive belt are synchronized to provide faithful reproduction of the original document.

After exposure of belt 14 the electrostatic latent image recorded on the photoconductive surface 15 is transported to development station 24, wherein developer is applied to the photoconductive surface 15 of the belt 14 rendering the latent image visible. The development station includes a magnetic brush development system including developer roll 25 utilizing a magnetic developer mix having course magnetic carrier granules and fusable toner colorant particles.

Copy sheets or final support material 31 are contained in a stack arranged on elevated support tray 26 in a desired orientation. With the stack at its elevated position, a sheet separator segmented feed roll 27 feeds individual sheets therefrom in the desired orientation, for example, short edge first, to a registration pinch roll pair 28. A sheet fed short edge first thus is moved through a sheet path or track within the machine such that its short edge dimension is the "cross-track" dimension of the sheet being fed. The sheet 31 is then forwarded thus to the transfer station 29 in proper registration with the image on the belt and the developed or toner image on the photoconductive surface 15 is brought into transfer contact with the sheet 31 within the transfer station 29. There the toner image is transferred from the photoconductive surface 15 to the contacting side of the final support sheet 31 with the aid of a transfer corotron 30.

Following transfer of the image thus, the final sheet 31 is separated from the surface 15 as it passes around the idler roll 18, and is advanced to the fuser apparatus 41 of the present invention wherein a pressure roll 51 and a heated fuser roll 52 fuse and fix the transferred toner image onto the sheet 31. After fusing the toner image to the copy sheet 31, the sheet is then advanced by output rolls 33 to a sheet output tray 34.

Although a preponderance of toner powder is transferred to the sheet or final support material 31, invariably some residual toner remains on the photoconductive surface 15 after such transfer. The residual toner particles are removed from the surface 15 of belt 14 by a cleaning station 35. As shown, the cleaning station 35 may include a cleaning blade 36 in scrapping contact with the surface 15. The blade 36 is contained within a cleaning housing 48 which has a cleaning seal 50 associated with an upstream opening of the cleaning housing. Alternatively, the toner particles may be mechanically cleaned from the photoconductive surface by a cleaning brush as is well known in the art.

It is believed that the foregoing general description is sufficient for the purposes of the present application to illustrate the general operation of an automatic xerographic reproduction machine 10 which can embody the fuser apparatus 41 in accordance with the present invention.

Figure 1:
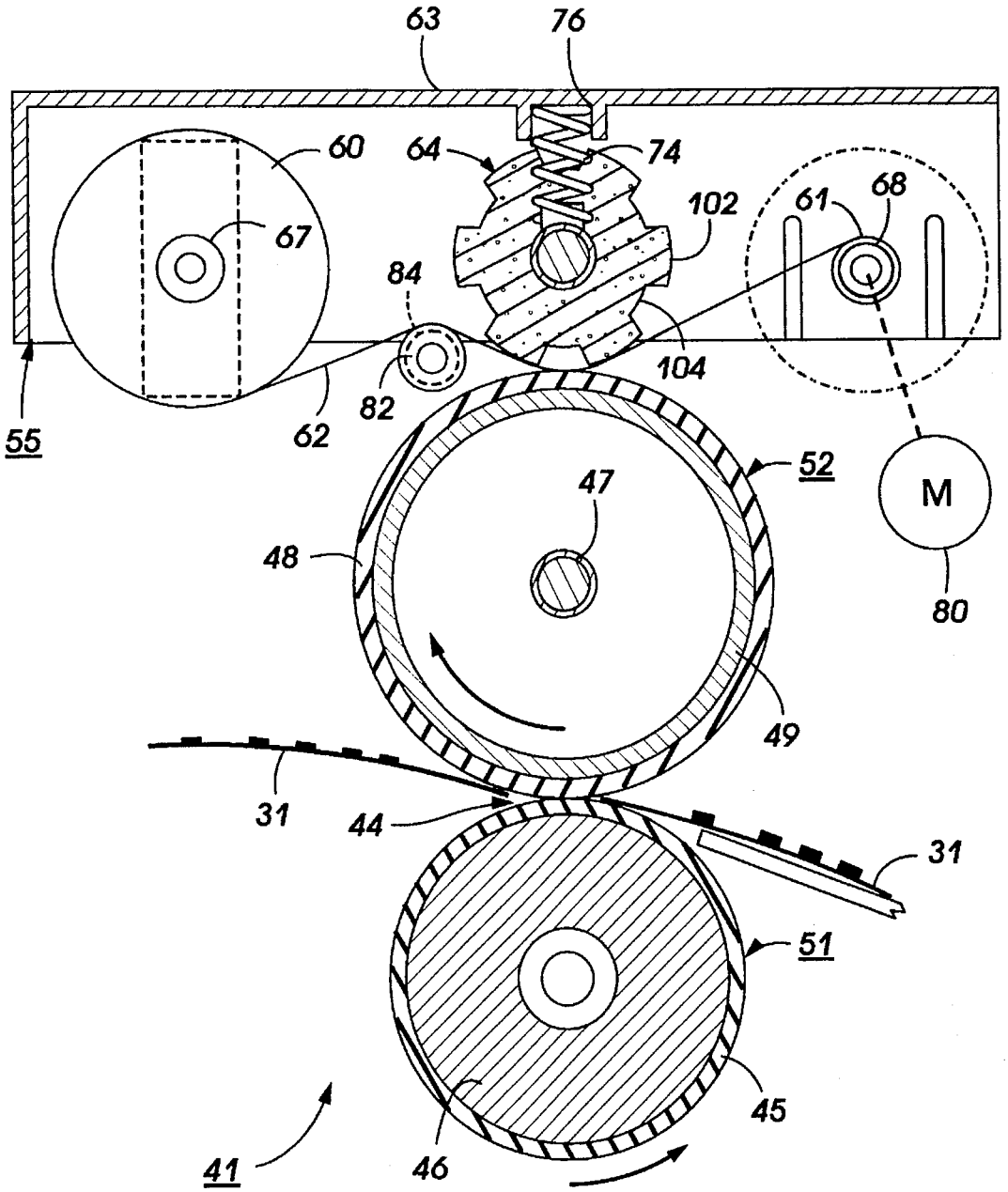
FIG. 1 is an end view in cross-section of a fuser apparatus incorporating a RAM system and a patterned RAM roll device of the present invention.

Referring now to FIGS. 1–4, the fuser apparatus 52, the RAM system and patterned roll of the present invention are illustrated in greater detail. As shown in FIG. 1, the fuser roll 52 is composed of a core 49 having coated thereon a thin layer 48 of an elastomer. The core 49 may be made of various metals such as iron, aluminum, nickel, stainless steel, etc., and various synthetic resins. Aluminum is preferred as the material for the core 49, although this is not critical. The core 49 is hollow and a heating element 47 is generally positioned inside the hollow core to supply the heat for the fusing operation. Heating elements suitable for this purpose are known in the prior art and may comprise a quartz heater made of a quartz envelope having a tungsten resistance heating element disposed internally thereof. The method of providing the necessary heat is not critical to the present invention, and the fuser member can be heated by internal means, external means or a combination of both. All heating means are well known in the art for providing sufficient heat to fuse the toner to the support. The thin fusing elastomer layer may be made of any of the well known materials such as the RTV and HTV silicone elastomers.

The fuser roll 52 is shown in a pressure contact arrangement with a backup or pressure roll 51. The pressure roll 51 comprises a metal core 46 with a layer 45 of a heat-resistant material. In this assembly, both the fuser roll 52 and the pressure roll 51 are mounted on bearings (not shown) which are mechanically biased so that the fuser roll 52 and pressure roll 51 are pressed against each other under sufficient pressure to form a nip in area 44. It is in this nip that the fusing or fixing action takes place. The layer 45 may be made of any of the well known materials such as fluorinated ethylene propylene copolymer or silicone rubber.

As illustrated, the fuser apparatus 41 includes a release agent management (RAM) system shown generally as 55. The RAM system 55 comprises a housing 63 which may typically be a one-piece plastic molded member having mounting elements such as slots or holes for an impregnated web saturated with a release agent such as oil, an impregnated web supply roll 60, a take-up roll 61 for the impregnated web, and the non-continuous patterned agent supply roll 64 of the present invention mounted as a pinch roll. The web supply roll 60 and web take-up roll 61 are supported in the housing 63 such that when the RAM system 55 is in place, the supply roll 60 is on one side of the fuser roll 52 and the take-up roll 61 is on the other side of the fuser roll, and the the impregnated web 62 is threaded from the supply roll 60 to the take-up roll 61 for movement along a path parallel adjacent the fuser roll 52. In addition, the non-continuous patterned agent supply roll 64 of the present invention is mounted opposite the fuser roll 52 as a pinch roll so as to urge a moving portion of the web 62 into release agent or oil applying engagement with the fuser roll 52.

The web supply roll 60 and web take-up roll 61 are each made from interchangeable rotatable tubular support cores 67 and 68 respectively, so as to enable the reversibility of the threaded section of web 62. The supply roll core 67 has a supply of release agent impregnated web material 62 wound around the core and is tensioned within the housing to resist unwinding by means of a leaf spring, not shown, at each end of the housing 63 which urges mounting collars, also not shown, into engagement with the rotatable tubular support core 67. As shown, the non-continuous patterned agent supply roll 64 of the present invention is spring biased toward the fuser roll 52 by two coil springs 74 at each end of the roll arrangement (only one of which is shown). Each spring at the end of the pinch roll 64 is mounted through a slot 76 for creating pressure between the impregnated web 62 and the fuser roll 52 in order to insure delivery of an adequate quantity of release agent to the fuser roll. A motor 80 and a suitable drive connection are provided for effecting rotation of the take-up roll 61 for transporting impregnated sections of the web 62 from the supply roll 60 to the take-up roll 61.

Any suitable web material capable of withstanding fusing temperatures of the order of 225° C. may be employed. Typically, the web material is capable of being impregnated with at least 25 grams per meter square of liquid release agent such as silicon oil. The web material may be woven or non-woven and of a sufficient thickness to provide a minimum amount of release agent for a desired life. For example, for a web material capable of holding about 30 grams of release agent per square meter, a thickness of 0.07 millimeters will provide a quantity of release agent capable of fusing about 100,000 prints. It should be understood that the principle function of the web is the delivery of the release agent and that a cleaning function wherein the fuser roll is cleaned, is secondary. The web is advanced by a clock motor driving the drive shaft of take-up roll 61

Figure 2:
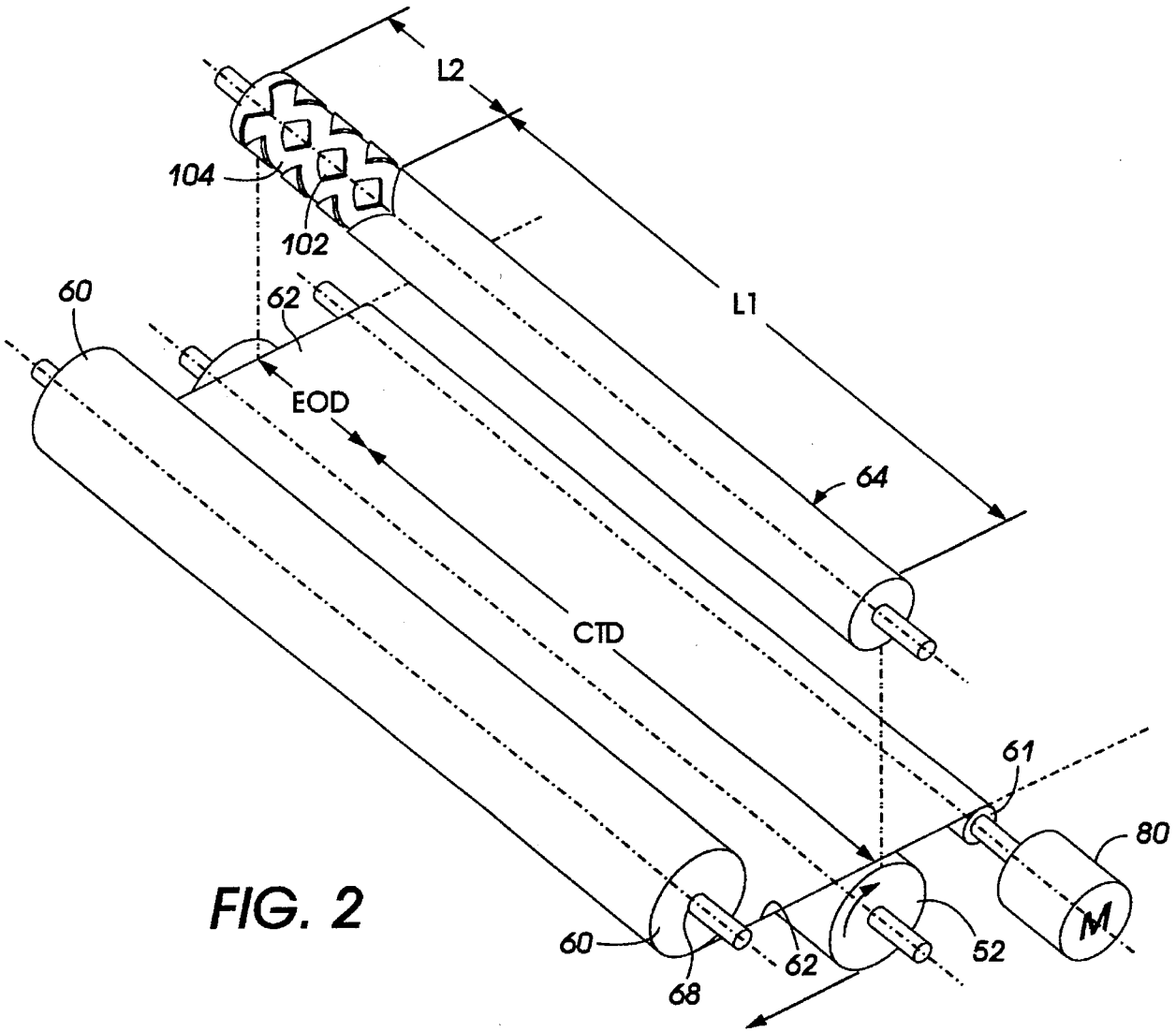
FIG. 2 is a partial exploded view of the fuser apparatus of FIG. 1 showing a cross-track dimension of copy sheets relative to first and second length portions of the patterned RAM roll device.

Referring in particular to FIG. 2, a copy sheet 31 (FIG. 1) being fused by the fuser apparatus 41 is fed registered to one end of the fuser roll, and along a path or track indicated by the arrow 100. Accordingly, the cross-track dimension of the sheet 31 is shown as CTD, and corresponds to a first length L1 of the non-continuous patterned roll 64, as shown. As is well known, passage of each copy sheet 31 over that portion of the fuser roll 52 corresponding to the dimension CTD, causes the sheet 31 to deplete or remove release agent or oil applied to such portion by the web 62. It is because of such depletion that it is necessary to reapply such release agent or oil to the fuser roll.

In applications where the sheets 31 are fed short edge first, the cross-track dimension CTD will be less than the usable and designed oiling or release agent receiving length (CTD plus EOD) of the fuser roller. Ordinarily therefore, a second portion of the fuser roller shown as EOD will lie outside the cross-track dimension CTD, and would receive applied release agent or oil, but will not lose such oil to any part of a sheet 31, unremoved, such release agent or oil applied to the portion EOD will tend to cause the pressure roll and fuser roll to undesirably swell in the portion EOD, and hence to fail prematurely. In accordance to the present invention, such undesirable swelling and premature failure is prevented by controllably reducing an amount of release agent or oil supplied by the web 62 in the web portion corresponding to a longitudinal length of the portion EOD of the fuser roll 52. As shown therefore, the first portion L1 of the release agent or oil supplying roll 64, preferably has a continuous agent supplying surface that uniformly contacts a corresponding dimension of the web 62 to supply it with oil, for example. A second portion L2 of the roll 64 according to the present invention has a non-continuous surface pattern that advantageously includes release agent supplying surface areas 102 for preventing total loss of oil, and release agent non-supplying surface areas 104 for reducing the amount of oil applied. The roll 64 overall therefore has a non-continuous surface pattern as shown.

The non-continuous patterned agent supply roll 64 of the present invention is preferably an open celled foam roll that may be made of any suitable material which is resistant to high temperatures of the order of the fusing temperature at 225° C. and that does not take a permanent set. Typically, it is made or molded from silicone rubber foam with open cells about 0.5 millimeters in their maximum dimension.

Figure 3:
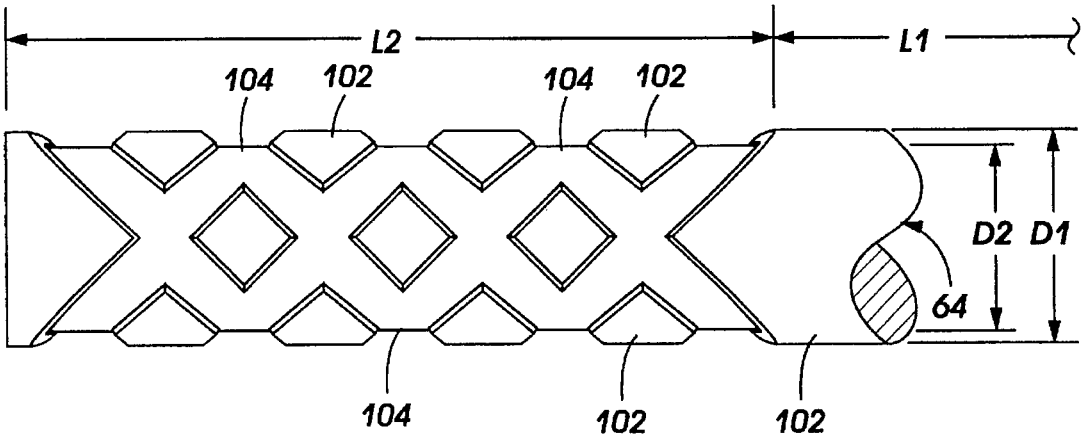
FIG. 3 is a side view of a first embodiment of the patterned RAM roll device of FIG. 2.

Referring now to FIG. 3, a first embodiment of the non-continuous surface pattern roll 64 of the present invention is illustrated. The roll 64 is an open celled foam roll that has an uncompressed outer diameter D1 as shown. The surface of the foam ordinarily forms release agent or oil supplying areas shown as 102, and having the diameter D1. Over a length of the roll 64 equal to the second portion L2 thereof as described above, the surface of the roll includes release agent/oil non-supplying areas 104, shown having a second diameter D2 that is sufficiently less than D1 such that during a loaded rotation of the roll 64, such areas 104 will not contact the web 62. Thus oil or release agent is not supplied to areas of the web corresponding to such areas 104. The areas 104 can be formed for example by removing some surface foam from areas of the surface originally having the greater diameter D1, or the roll 64 could initially be formed as such.

In order to prevent a total loss of oil in the portion EOD of the fuser roll corresponding to L2, the areas 102 constitute only a small percentage of the total surface area of the roll 64 within the portion L2. The pattern formed by areas 102 of the portion L2 must be staggered such that a total and even application of release agent or oil is achieved at least once over each unit of the surface of the web 62 corresponding to and contacting the portion L2 of roll 64, over an interval in which about 850 copies are fused by the fuser apparatus 41. In other words, first diameter D1 of the foam or agent saturated material, and the staggered pattern of the release agent supplying areas 102 should be selected such that each unit area of the fuser roll 52 corresponding to the second longitudinal portion L2 of the roll 64 is contacted by a release agent supplying surface area 102, once every predetermined member (e.g. 850) of copy sheets that are fused Such a pattern can be of straight or twisted spline, crosshatch, dimple, or other fashion that would aid in manufacturability, and durability of the roll 64 among other criteria.

Figure 4:
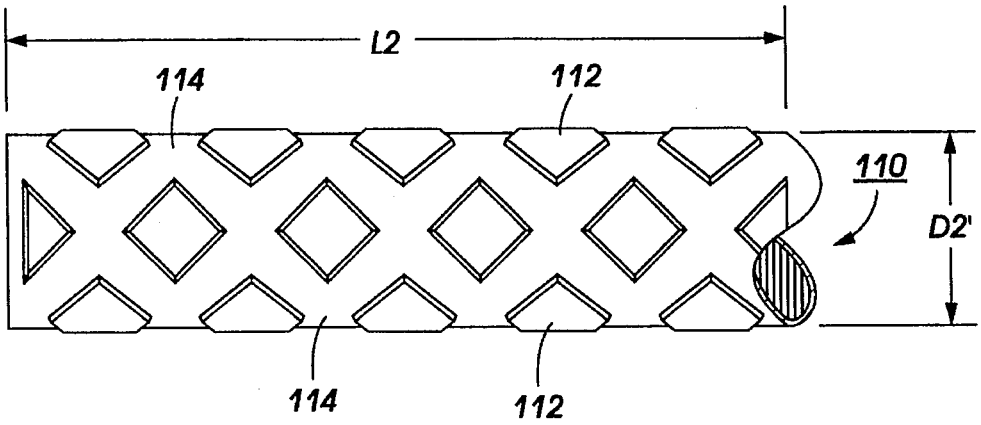
FIG. 4 is a side view of a patterned sleeve for creating a second embodiment of the patterned RAM roll device of FIG. 2.

Referring now to FIG. 4, a sleeve member 110 for forming a second embodiment of the non-continuous surface pattern roll 64 of the present invention is illustrated. In this embodiment, the roll 64 is also an open celled, compressible foam roll that has an uncompressed outer diameter D1. The uncompressed foam will form the release agent or oil supplying surface areas 102 (of the non-continuous surface pattern in portion L2 of roll 64) through open areas 112 formed in the sleeve member 110 in accordance with a staggered pattern. The sleeve member 110 is made of a release agent impervious material such as a metal or high temperature plastic. As shown, the sleeve member 110 includes solid closed areas 114 comprised of the metal or high temperature plastic material, and cutout or open areas 112 therethrough. Preferably, the sleeve member has a length equal to L2, and an external diameter D2' that is equivalent to D2, and is thus less than the first diameter D1 of the uncompressed foam for forming areas 102 as above. In this embodiment, the sleeve member 110 is slipped onto an end of the foam roll to tightly fit over the foam, thereby compressing the foam in areas corresponding to the solid closed areas 114 of the sleeve member. These areas 114 thus prevent the oil saturated foam from contacting the web 62 to supply it with oil, thus comprising the oil non-supplying areas 104 of this embodiment. At the same time, the saturated and compressible material or foam protrudes through the open areas 112 of the sleeve to form the release agent supplying surface areas 102 of this embodiment.

One advantage of the second embodiment of the present invention is that such a sleeve member can be customized to retrofit (in the field) any cross-track dimension of copy sheets being fused by the fuser apparatus 41. Adding the perforated sleeve member 110 to a foam roll as such, allows sections of the foam roll to protrude through the perforations or openings 112, thus causing the sleeve to only be in contact with the web in these areas at the nip interface. This reduces or eliminates oil transfer to the fuser roll in the non-perforated sections 114. The perforations or openings 112 in the wall of the sleeve member are, for example, 9 mm square diamonds for providing a 31% perforated area coverage of the total surface of the sleeve. The perforations are preferably formed in circumferentially spaced staggered rows, so that each row is out of phase with the rows next to it, and so that axially corresponding open areas of adjacent rows are out phase axially with each other. This sleeve member 110 as such is placed over an existing pinch foam roll thus reducing the effective oil transport area and quantity of fuser oil transferred from the web to the heat roll in the unused area EOD of the system.

The non-continuous patterned roll 64 of the present invention will provide discreet application of fuser oil over the length of the fuser roll in order to aid in paper stripping, and long roll life. The advantageous feature of this invention is the ability to roll 64 to apply oil from a standard fuser oil web at different rates, axially along the roll. This thus allows accounts that use an abnormal amount of short edge feed copy sheets to retrofit the roll 64 in accordance with the sleeve of the second embodiment. This prevents an undesirable build up of oil on unused areas EOD of the fuser roll, which oil ordinarily would lead to fuser roll swelling and premature roll failure. The implementation of this invention will provide an increase in reliability and customer satisfaction with minimal or no impact to cost.

An auxiliary release agent or oil feeding device such as an oil application tube 82, may be provided as shown (FIG. 1). The tube 82 is provided with holes 84 in the top thereof. The tube is supported in contact with the web 62 for applying oil to the web during high volume imaging or when fixing color images. The holes have a diameter of about 7 mils. An inlet at one end of the tube 82 supplies oil to the tube. A source of oil, not shown, for filling the tube 82 can be a closed system which supplies the oil by gravity or through a pumping action synchronized with fuser roll rotation speed.

The addition of oil to the web, as will be appreciated, results in an adequate amount of oil being available for high volume and color imaging thereby preventing fuser roll degradation due to an insufficient oil supply. The addition of oil will also increase the fuser roll release life for a low volume machine. A controller 90 FIG. 1, operatively connected to a user interface (not shown) serves to effect application of extra oil to the web via the tube 82.

It is, therefore, apparent that there has been provided in accordance with the present invention, a fuser apparatus RAM system including a non-continuous surface pattern release agent or oil supplying roll that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. In a reproduction machine having a fuser roller for fusing toner images on an image bearing sheet, a release agent management (RAM) system for applying an image offset preventing release agent to the fuser roller, the RAM system comprising:

(a) a rotatable supply core located to a first side of the fuser roller;

(b) a rotatable take-up core located to a second side of the fuser roller;

(c) a movable release agent impregnated web member including a section threaded from said supply core to said take-up core for contacting, and applying release agent to, the fuser roller; and (d) a release agent supplying roll positioned for contacting and supplying release agent to said threaded portion of said web member at a point between said supply core and said take-up core, said release agent supplying roll having a non-continuous surface pattern comprising release agent supplying surface areas for contacting said threaded section of said web member, and release agent non-supplying surface areas out of contact with said threaded section of said web member.

2. The RAM system of claim 1, wherein said release agent supplying roll is comprised of a release agent saturated material defining a first diameter and forming said release agent supplying surface areas, and wherein said release agent non-supplying surface areas of said non-continuous surface pattern are formed into said saturated material such that each release agent non-supplying surface area has a second diameter less than said first diameter of said roll for preventing contact between said each release agent non-supplying surface area and said web member, when said release agent supplying areas are in contact with said web member.

3. The RAM system of claim 1, wherein said release agent supplying roll is comprised of:

(a) a release agent saturated and compressible material defining a first diameter and forming said release agent supplying surface areas of said non-continuous surface pattern; and (b) a sleeve member made of a material impervious to the release agent, said sleeve member (i) having an external diameter less than said first diameter of said saturated and compressible material, (ii) being tightly fitted over said saturated and compressible material, and (iii) including a pattern of open areas in a wall of said sleeve member through which said saturated and compressible material of said release agent supplying roll protrudes to form said release agent supplying surface areas, and a pattern of solid non-open areas forming said release agent non-supplying areas.

4. The RAM System of claim 2, wherein said release agent supplying roll includes a first longitudinal portion having a continuous surface pattern for contacting said threaded section of said web member, and a second longitudinal portion having said non-continuous surface pattern for reducing an amount of release agent applied per revolution of said roll to areas of said web member in contact with said second longitudinal portion of said release agent supplying roll.

5. The RAM system of claim 3, wherein said sleeve member has a length shorter than a length of said release agent supplying roll so as to form said release agent non-supplying surface areas only over a length of said release agent supplying roll equal to said length of said sleeve member.

6. The RAM system of claim 4, wherein said first longitudinal portion of said release agent supplying roll has a length less than a length of the fuser roller, and equal to a cross-track dimension of image bearing copy sheets being fused by the fuser roller so as to prevent swelling and premature failure of the fuser roller.

7. The RAM system of claim 5, wherein said sleeve member is formed out of a high temperature plastic material.

8. The RAM system of claim 5, wherein said sleeve member is formed out of a metallic material.

9. The RAM system of claim 6, wherein said first diameter of said agent saturated material, and a staggered pattern of said release agent supplying surface areas and of said release agent non-supplying surface areas, are selected such that each unit area of the fuser roller surface corresponding to said second longitudinal portion of said agent supplying roll is contacted by a release agent supplying surface area of said agent supplying roll once every predetermined number of copy sheets fused by the fuser roller.

10. The RAM system of claim 7, wherein said pattern of open areas of said sleeve member are spaced circumferentially, and comprise longitudinal rows on said sleeve member.

11. The RAM system of claim 10, wherein corresponding open areas in adjacent rows of said pattern of open areas are out of phase axially relative to each other.

* * * * *